US005520020A

United States Patent [19]

Okuno

[11] Patent Number: 5,520,020

[45] Date of Patent: May 28, 1996

[54] METHOD OF FORMING PIPING AT AN END OF A KNITTED FABRIC AND KNITTED FABRIC HAVING PIPING FORMED AT A FABRIC END

[75] Inventor: Masao Okuno, Wakayama-ken, Japan

[73] Assignee: Shima Seiki Mfg., Ltd., Wakayama, Japan

[21] Appl. No.: 52,973

[22] Filed: Apr. 27, 1993

[30] Foreign Application Priority Data

Apr. 27, 1992 [JP] Japan ..... 4-107482

[51] Int. Cl.[6] ..... D03D 25/00; D04B 15/66; D04B 7/04; D04B 9/46

[52] U.S. Cl. ..... 66/64; 66/75.1; 66/172 E; 428/230

[58] Field of Search ..... 428/230; 66/76, 66/70, 171, 172 E, 175, 64, 75.1

[56] References Cited

U.S. PATENT DOCUMENTS

| | | | |
|---|---|---|---|
| 2,307,607 | 1/1943 | Snader | 62/172 E |
| 2,356,484 | 8/1944 | Wagenhorst | 66/173 |
| 2,643,532 | 6/1953 | Sandri | 66/176 |
| 4,481,793 | 11/1984 | Cuche et al. | 66/75.2 |
| 5,055,348 | 10/1991 | Kataoka et al. | 428/245 |
| 5,174,134 | 12/1992 | Okuno | 66/64 |
| 5,202,070 | 4/1993 | Schneider | 264/103 |
| 5,250,351 | 10/1993 | Kondou et al. | 428/231 |

*Primary Examiner*—Sharon Gibson
*Assistant Examiner*—Kathryne E. Shelborne
*Attorney, Agent, or Firm*—Edwin E. Greigg; Ronald E. Greigg

[57] ABSTRACT

A method of forming piping at an end of a knitted fabric for a knitted garment by using a flat knitting machine. At a point at which piping is to begin loops which compose the knitted fabric are held on the front or rear needles and the other needles are held empty and elastic yarn is hooked by specified front and rear needles. The piping fabric part is knitted only by the knitting needles on one side or by both the knitting needles on one side and the empty needles on the other side. The loops at the end of this piping fabric part and the previously hooked elastic yarn are joined together to form the piping and then the loops of the joined part are released from the knitting needles using the elastic yarn.

2 Claims, 3 Drawing Sheets

METHOD OF FORMING PIPING AT AN END OF A KNITTED FABRIC AND KNITTED FABRIC HAVING PIPING FORMED AT A FABRIC END

BACKGROUND OF THE INVENTION

This invention relates to a method of forming piping at the end of a knitted fabric for knitted garments such as pullover and cardigan sweaters, vests, etc., and to a knitted fabric having piping formed at its fabric end.

For example, when forming piping on the neckline (fabric end) of a sweater or other knitted garment, with the prior art, after the body (fabric) of the garment had been knitted, a fabric knitted into a strip shape for the purpose of forming the piping was folded in half and its loose edges were joined to the neckline of the garment by linking or some other method, thus forming piping on the neckline.

In addition, with integral knits, a common method was to knit the garment with a collar attached to a crew neck or a boat neck, and then, after finishing the fabric end of the neck opening, to use a hook stitch to join the fabric end to the place where the knitting of the neckline began.

With the methods of the prior art described above, when the fabric for forming the piping was folded in half and joined to the neckline by linking or some other method, in addition to the knitting of the fabric of the garment body, it was necessary to also knit the fabric knitted into a strip shape for the purpose of forming the piping, thus decreasing productivity.

Moreover, whether the fabric for forming the piping was folded in half and joined to the neckline by linking or some other method, or whether a hook stitch was used to join the end of the collar to the place where the knitting of the neckline began, considerable time and labor were required for the joining process, and this resulted in a decrease in productivity.

Thus, this invention has been proposed in consideration of the problems mentioned above, and the objective of the invention is to make it possible to provide knitted garments which are comfortable to wear while at the same time increasing productivity.

SUMMARY OF THE INVENTION

In order to achieve the objective mentioned above, the method of forming piping at the fabric end of a knitted fabric of this invention is characterized in that: a knitted fabric is knitted using a flat knitting machine on which are arranged at least front and rear needle beds in which multiple knitting needles are retractably inserted; at the point at which the formation of the piping at the fabric end of the knitted fabric is to begin, with the loops which compose the knitted fabric held onto either the front or rear knitting needles, the other set of knitting needles are kept empty, and elastic yarn is hooked by specified front and rear needles of the hooked elastic yarn, that in the knitting needles on the empty-needle side is kept hooked and the piping fabric part is knitted only by the knitting needles on one side, or by both the knitting needles on one side and the empty knitting needles on the other side; and the loops at the end of this piping fabric part and the aforementioned hooked elastic yarn are joined together to form the piping, and then the loops of the joined part are released from the knitting needles using the elastic yarn.

In addition, the knitted fabric having piping formed on its fabric end has the elastic yarn hooked at the part where the formation of the piping at the fabric end is begun joined together with the loops at the end of the piping fabric part, and the loops of said joined part are released from the knitting needles using elastic yarn.

A fabric is knitted on a flat knitting machine, and when the end of the fabric where the formation of the piping is to begin is reached, first, with the loops which compose the fabric hooked onto either the front or rear knitting needles, the other set of needles is kept empty, and elastic yarn is hooked by specified needles on the front and rear.

Next, of the hooked elastic yarn, with that hooked by the knitting needles on the empty-needle side kept hooked, the piping fabric part is knitted by the other knitting needles. Because one end of this knitted piping fabric part is kept hooked by the knitting needles on the empty-needle side, it is difficult for the knitted piping fabric part to drop down; however, by using a stitch presser or a sinker, for example, to press down the loops of the piping fabric, the elastic yarn hooked by the knitting needles on the empty-needle side stretches, and an appropriate amount of tension acts upon the loops of the piping fabric, thus making it possible to perform quality knitting.

Thus, when the piping fabric part is knitted to the specified length and the end of the piping fabric part is reached, the loops at the fabric end are joined to the elastic yarn hooked by the knitting needles on the empty-needle side, and then the loops of the joined part are released from the knitting needles using elastic yarn, thus accomplishing the knitting of a fabric having piping formed on it.

With the piping part of the fabric knitted in this way, in addition to the end of the piping fabric part being strongly pulled in by the elasticity of the elastic yarn inserted at the start of the piping fabric part, the part released from the knitting needles by the elastic yarn is also sufficiently compressed in the direction at right angles to the wale by this elasticity of the elastic yarn.

DETAILED DESCRIPTION OF THE PREFERRED EMBODIMENT

The following is an explanation of one embodiment of this invention based on the accompanying drawings.

Figure 1:
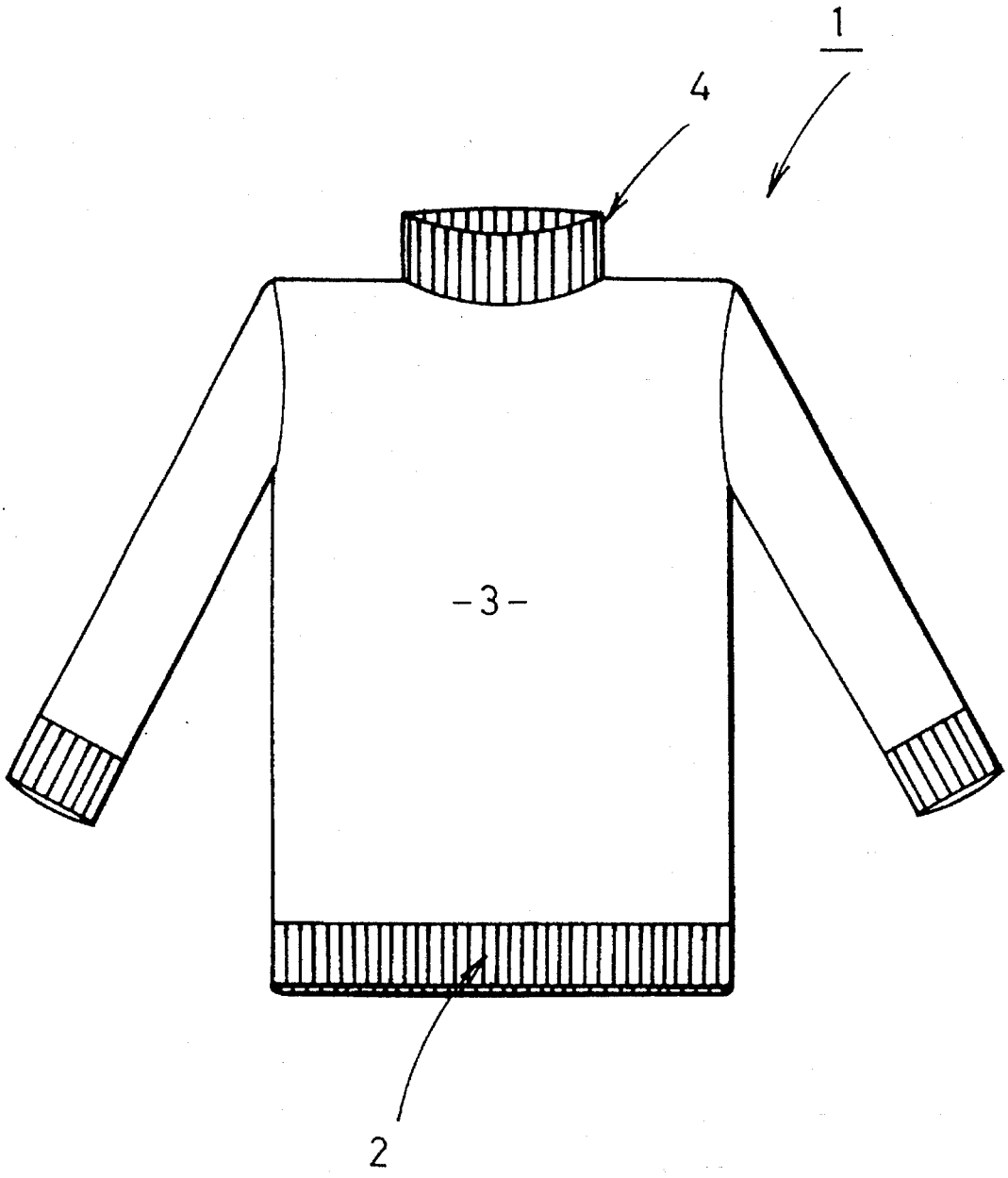
FIG. 1 shows a simplified front view of a pullover sweater knit by the method of this invention.

FIG. 1 shows a front view of a pullover sweater, which is one type of knitted garment. Using a flat knitting machine (not shown) on which are arranged at least one pair of front and rear needle beds in which multiple knitting needles are retractably inserted, knitting of the sweater 1 is begun from a bottom hem rib part 2, continuing up from the top of the hem rib part 2, a body part (fabric) 3 having a plain-knit structure is knitted by the front knitting needles, and then at the end of the body part 3 is a neckline part 4 formed into the shape of piping using a rib stitch.

Next, the knitting of the neckline part 4 which is the end of the body part 3 will be explained based on FIG. 2. However, although the wale which corresponds to the body part 3 and the neckline part 4 is actually knitted by a specified number of multiple knitting needles, for convenience, only the part corresponding to seven knitting needles is shown, and the numbers along the left edge of the figure indicate the knitting courses.

First, in course 1, ground yarn is supplied to the front knitting needles and the end of the body part 3 is knitted in a plain-knit structure. Then, in course 2, elastic yarn is supplied and hooked in a zig-zag pattern by the specified knitting needles front and rear.

For the elastic yarn used here, it is preferable to use yarn which shrinks when heated and which maintains its elasticity after shrinking. However, it is also possible to use a textile fiber having contraction-expansion elasticity, such as spandex, or a yarn which, when heated, will, shrink and the outer part of which will fuse and provide adhesiveness, and which maintains its elasticity after shrinking and adhesion, such as a textile fiber with a three-layer construction composed of a textile fiber layer having contraction-expansion elasticity for its core part, a protective textile fiber layer for its middle part, and a heat-fusing layer for its outer part.

In course 3, in order to form a 1×1 rib fabric on the neckline part 4, the loops of every other one of the front knitting needles which knitted the end part of the body part 3 using ground yarn are transferred to the corresponding rear knitting needles.

In course 4, the rear knitting needles are moved one-half pitch to the left, and then ground yarn is supplied and the knitting of the fabric is begun.

In courses 5 and 6, the 1×1 rib fabric is knitted using ground yarn.

This knitting in courses 5 and 6 is repeated the specified number of times, and then in course 7 the ground yarn is removed from the knitting process. Because the part at which the knitting of the 1×1 rib fabric knitted in courses 5 and 6 starts is held by the elastic yarn which was hooked in course 2, it is difficult for the knitted piping fabric part to drop down; however, by using a stitch presser or a sinker, for example, to press down the loops of the piping fabric, the elastic yarn which is holding the part at which the knitting of the rib fabric starts stretches, and an appropriate amount of tension acts upon the loops of the knitted piping fabric, thus making it possible to perform quality knitting.

In course 8, when the elastic yarn hooked by the rear knitting needles and the loops of the rear knitting needles used in the knitting of the rib fabric in courses 4 through 7 explained above are transferred to the front knitting needles, the end of the rib fabric is joined together with the place at which the knitting of the rib fabric starts, thus forming the piping.

Later, after elastic yarn is supplied from the left or the right to the front right-edge knitting needles and a loop is formed in courses 9 and 10, this loop is transferred to the adjacent knitting needle to the left in course 11 and the loop of the front right-edge knitting needles is cast off.

By repeating these courses 9 through 11 over and over again from course 12 through course 26, the loops hooked in course 8 onto the front knitting needles, of which for convenience only the part corresponding to seven needles is shown, are bound off by elastic yarn, leaving the loop hooked onto the left-edge needle, and the bound-off loops are cast off from the knitting needles.

Then, after loops are formed in courses 27 through 29, the loop hooked onto the left-edge knitting needle is cast off from the needle.

With the piping part of the fabric knitted in this way, in addition to the fabric end being strongly pulled in by the elasticity of the elastic yarn inserted at course 2, the part bound off by the elastic yarn in courses 9 through 29 is also sufficiently compressed in the direction at right angles to the wale by this elasticity of the elastic yarn.

Figure 3:
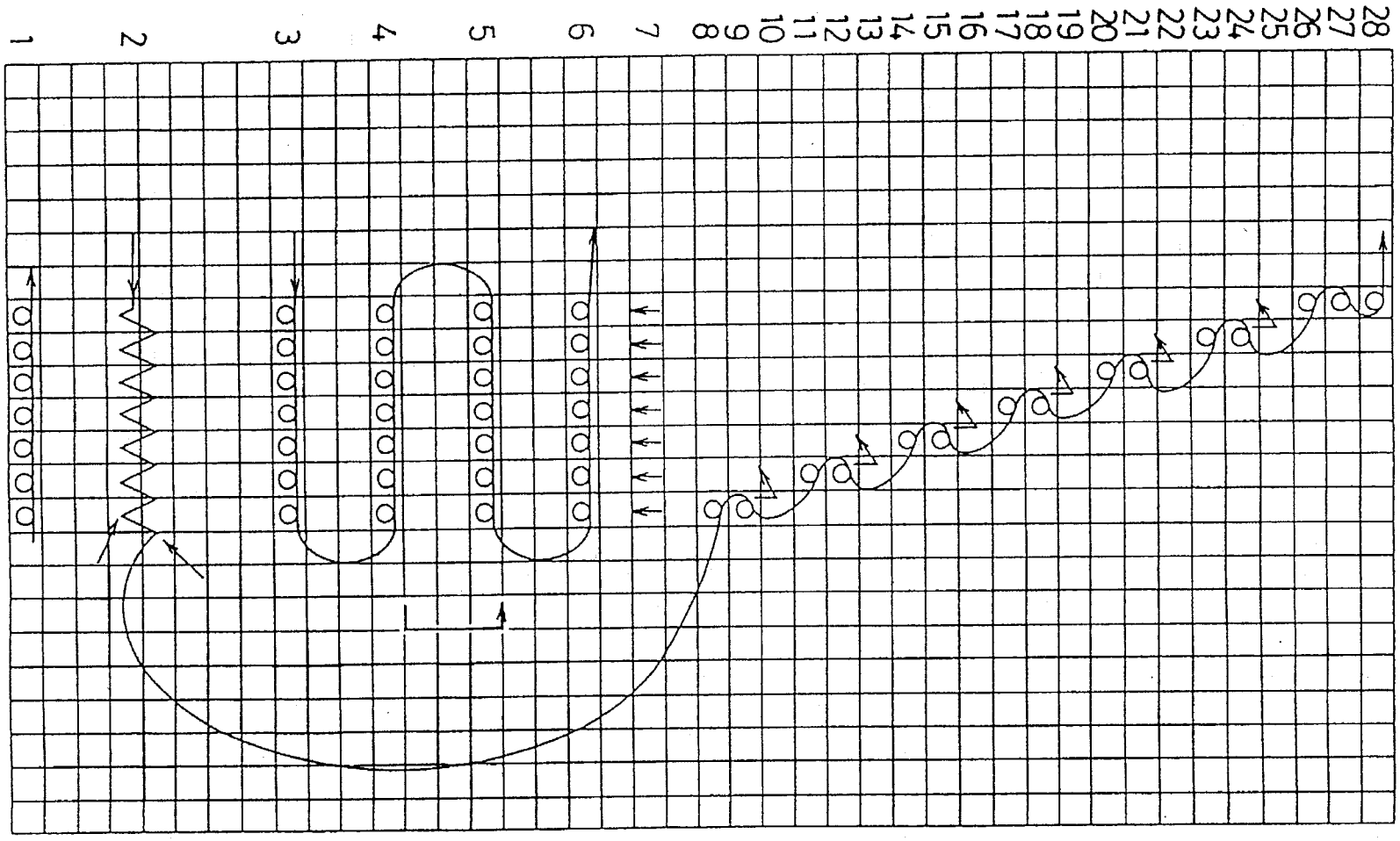
FIG. 3 shows another knitting course of the method of the invention.

It should be noted that although in the embodiment described above the neckline part 4 is formed of 1×1 rib fabric, it is of course also possible, as shown in FIG. 3, house a plain-kit structure in place of this rib fabric.

Figure 2:
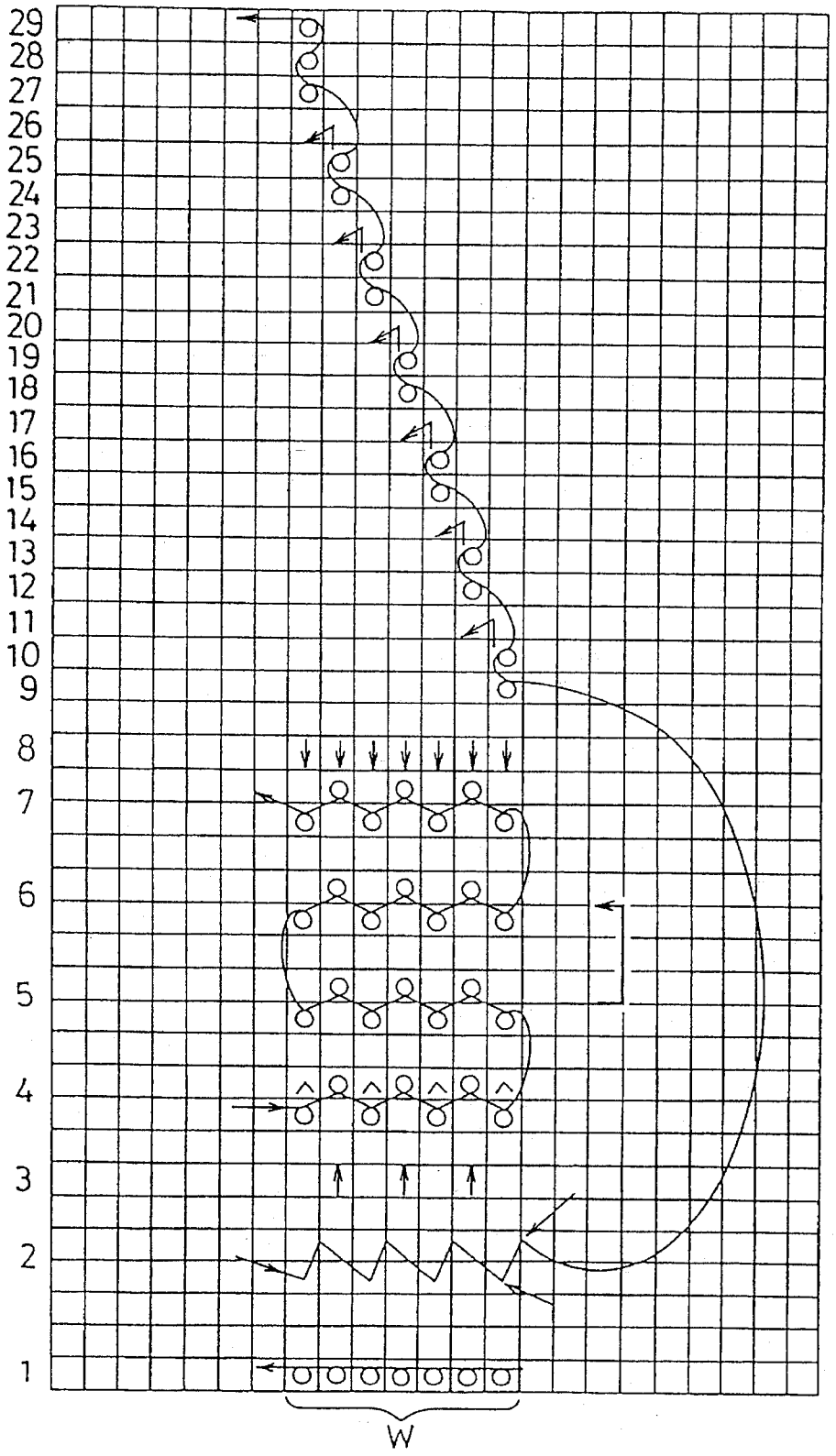
FIG. 2 shows one knitting course of the method of this invention.

In other words, in place of the part from course 2 through course 7 in FIG. 2 of the embodiment described above, in FIG. 3, elastic yarn is hooked by all of the knitting needles in course 2, and then in courses 3 through 6, ground yarn is used to form a plain-knit structure, with all of the other compositions and actions being the same as in the embodiment described above.

In addition, although the finishing process of the piping fabric part; in the embodiment described above is transferred by knitting two stitches using elastic yarn, it is of course also possible to transfer it by knitting one stitch or by knitting three or more stitches.

Furthermore, although in the embodiment described above the explanation was for the neckline of a pullover sweater, if, for example, the knitting is begun from the neckline of the sweater and the rib part is the end of the fabric, it is of course possible to form the piping on this rib part. In the same way, it is of course possible to apply this invention for sleeve cuffs, and also to apply it for knitted garments other than pullover sweaters.

What is claimed is:

1. A method of forming piping at an end of a knitted fabric with a flat knitting machine having at least front and rear needle beds on each of which a plurality of knitting needles are retractably arranged, comprising:

holding loops of the knitted fabric with knitting needles on either the front or rear needle beds to knitting needles on the needle bed not holding loops of knitted fabric;

hooking an elastic yarn by the knitting needles of every other of the knitting needles on each of the front and rear needle beds;

knitting a piping fabric part with the knitting needles holding loops of the knitted fabric and the knitting needles on the needle bed not holding the loops of fabric;

transferring the yarn hooked with the knitting needles on the needle bed not holding the loops of fabric to the needle bed on which loops at the end of this piping fabric part are held;

supplying an elastic yarn to the knitting needle placed at either a right-edge or a left-edge of the knitting needles holding the loops;

forming a new loop with the supplied elastic yarn;

transferring the new loop to an adjacent knitting needle holding the loop, and repeating the latter three steps to release the loops from the knitting needles.

2. A method of forming piping at an end of a knitted fabric with a flat knitting machine having at least front and rear needle beds on each of which a plurality of knitting needles are retractably arranged, comprising:

holding loops of the knitted fabric with knitting needles on either the front or rear needle beds to knitting needles on the needle bed not holding loops of knitted fabric;

hooking an elastic yarn by the knitting needles of every other of the knitting needles on each of the front and rear needle beds;

knitting a piping fabric part only with the knitting needles holding loops of the knitted fabric;

transferring the yarn hooked with the knitting needles on the needle bed not holding the loops of fabric to the needle bed on which loops at the end of this piping fabric part are held;

supplying an elastic yarn to the knitting needle placed at either a right-edge or a left-edge of the knitting needles holding the loops;

forming a new loop with the supplied elastic yarn;

transferring the new loop to an adjacent knitting needle holding the loop, and repeating the latter three steps to release the loops from the knitting needles.

* * * * *